US011218794B2

(12) United States Patent
Bai et al.

(10) Patent No.: US 11,218,794 B2
(45) Date of Patent: Jan. 4, 2022

(54) EARPHONE

(71) Applicant: Anker Innovations Technology Co., Ltd., Changsha (CN)

(72) Inventors: Xuefeng Bai, Changsha (CN); Hongchao Zhou, Changsha (CN)

(73) Assignee: Anker Innovations Technology Co. Ltd., Changsha (CN)

( * ) Notice: Subject to any disclaimer, the term of this patent is extended or adjusted under 35 U.S.C. 154(b) by 433 days.

(21) Appl. No.: 16/328,277

(22) PCT Filed: Feb. 9, 2017

(86) PCT No.: PCT/CN2017/073144
§ 371 (c)(1),
(2) Date: Feb. 25, 2019

(87) PCT Pub. No.: WO2018/058879
PCT Pub. Date: Apr. 5, 2018

(65) Prior Publication Data

US 2021/0289284 A1 Sep. 16, 2021

(30) Foreign Application Priority Data

Sep. 27, 2016 (CN) ..... 201610853908.6

(51) Int. Cl.
*H04R 1/10* (2006.01)
*H04R 1/28* (2006.01)

(52) U.S. Cl.
CPC ..... *H04R 1/1058* (2013.01); *H04R 1/1016* (2013.01); *H04R 1/2846* (2013.01); *H04R 2201/105* (2013.01)

(58) Field of Classification Search
CPC .. H04R 1/1058; H04R 1/1016; H04R 1/2846; H04R 2201/105
See application file for complete search history.

(56) References Cited

U.S. PATENT DOCUMENTS

2009/0041284 A1 2/2009 Tanaka
2013/0251172 A1 9/2013 Mosseri
2017/0223443 A1* 8/2017 Silvestri ..... H04R 1/2849

FOREIGN PATENT DOCUMENTS

CN 201063826 Y 5/2008
CN 104853268 A 8/2015
(Continued)

OTHER PUBLICATIONS

EP17854340.1; Extended European Search Report dated Feb. 25, 2020; 10 pages.
(Continued)

*Primary Examiner* — Tuan D Nguyen
(74) *Attorney, Agent, or Firm* — Banner & Witcoff, Ltd.

(57) ABSTRACT

The present invention relates to an earphone, comprising an earphone body, an earphone cord, and a fixing member. The earphone body includes an earplug portion, a connecting portion, and a body portion. The fixing member shaped as a ring, and the middle portion of the ring includes a through hole. The fixing member includes a top wall located at an edge of the ring. The top wall is made of an elastic material. Among them, the connecting portion is connected to the earplug portion and the body portion. The connecting portion passes through the through hole and is fastened in the fixing member, and the fixing member and the connecting portion are members of the earphone that are placed in the cavitas conchae of the human ear. The beneficial effects of the present invention are that since the top wall of the fixing portion is made of a material that is susceptible to deformation, adaptive deformation is performed to match the different cavitas conchae, when subjected to the compression of the cavitas conchae. Thus, this improves the comfort of the earphones.

11 Claims, 3 Drawing Sheets

(56) References Cited

FOREIGN PATENT DOCUMENTS

| | | | |
|---|---|---|---|
| CN | 105392080 | A | 3/2016 |
| CN | 105721969 | A | 6/2016 |
| JP | 2006222492 | A | 8/2006 |

OTHER PUBLICATIONS

JP 2019-504930; Office Action, dated Feb. 21, 2020; 3 pages of English Translation, 3 pages Original Issue.
Office Action received in Chinese Application No. 201610853908.6, dated Apr. 3, 2018, 5 pages and 5 pages English translation.
Office Action received in Chinese Application No. 201610853908.6, dated Jul. 5, 2017, 5 pages and 4 pages English translation.

* cited by examiner

EARPHONE

TECHNICAL FIELD

The present invention relates to an audio playback device, in particular, to an earphone.

BACKGROUND

As one of the most popular audio playback devices, earphones have become an indispensable part of our work and life. Therefore, in addition to the audio quality, the comfort and stability of wearing are also indispensable evaluation factors for the consideration of its superiority.

However, it is well known that the structure of the human external ear is very complicated and varies from person to person. The main difference is reflected in the diameter and depth of the cavitas conchae, and the development of the antitragus and the tragus. Therefore, designers or engineers need to reduce the shape of the part of the earphone that enters the ear (the parts placed inside the cavitas conchae of the human ear) to the most simplified form for most complex situations.

However, there are still cases where the size is not suitable or the shape is not suitable, thereby reducing the comfort and stability of wearing.

SUMMARY

The technical problem to be solved by the present invention is to provide an earphone that may be adaptively adjusted to match the structure of a plurality of human external ears.

In order to solve above technical problem, the present invention provides the following technical solution:

In one aspect, the present invention provides an earphone comprising an earphone body, and a fixing member; the earphone body includes an earplug portion, a connecting portion, and a body portion; the fixing member is a ring, and the middle portion of the ring is a through hole; the fixing member includes a top wall located at an edge of the ring, and the top wall is made of a soft material; among them, the connecting portion is connected to the earplug portion and the body portion; the connecting portion passes through the through hole and is fastened in the fixing member; and the fixing member and the connecting portion are members of the earphone that are placed in the cavitas conchae of the human ear.

In some embodiments, the ear bone includes a tragus and an antitragus, and the fixing member is fixed in the cavitas conchae by the tragus and the antitragus.

In some embodiments, the top wall is made of silica gel.

In some embodiments, the top wall is thin-walled, making it more susceptible to deformation.

In some embodiments, the fixing member further includes side walls on both sides of the ring, and the top wall and the side walls are enclosed to form an air groove.

In some embodiments, the top wall is provided with a vent hole, and when the top wall is deformed, air in the air groove may be discharged from the vent hole.

In some embodiments, the side wall is made of a material having a certain hardness such that the fixing member serves as a support.

In some embodiments, the side wall is made of a hard material, or a soft material having a thickness.

In some embodiments, the vent hole is provided at an upper portion of the fixing member.

In some embodiments, the ring formed by the fixing member is circular; or the portion of the ring on one side of the tragus is circular, and the portion thereof on the side of the antitragus is elliptical.

In some embodiments, in the cross section of the fixing member, the air groove has a dumbbell shape, and the cross section is perpendicular to the plane in which the fixture is located and passes through the diameter of the fixing member.

The beneficial effects of the present invention are that since the top wall of the fixing portion is made of a material that is susceptible to deformation, adaptive deformation is performed to match the different cavitas conchae when subjected to the compression of the cavitas conchae. Thus, this improves the comfort of the earphones.

REFERENCE NUMERALS

| | |
|---|---|
| Earphone body | 10 |
| Earplug portion | 11 |
| Connecting portion | 12 |
| Body portion | 13 |
| Earphone cord | 20 |
| Fixing member | 30, 30a |
| Top wall | 31 |
| Side wall | 32 |
| Air groove | 33 |
| Vent hole | 34 |
| Through hole | 35 |
| Tragus | A |
| Antitragus | B |

Detailed Description of the Embodiments

In order that the objectives, technical schemes and advantages of the present invention will become more apparent, the present invention will be described in more detail with reference to the drawings and examples above. It should be understood that the specific embodiments described herein are only for illustrating but not for limiting the present invention.

Furthermore, technical features involved in each embodiment of the present invention described as below could be combined as long as they don't contradict with each other.

Figure 1:
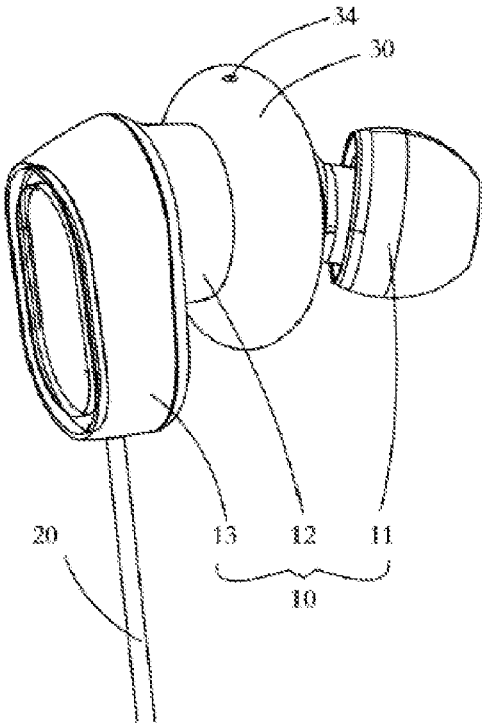
FIG. 1 is a perspective view of a first embodiment of an earphone according to the present invention.
Figure 2:
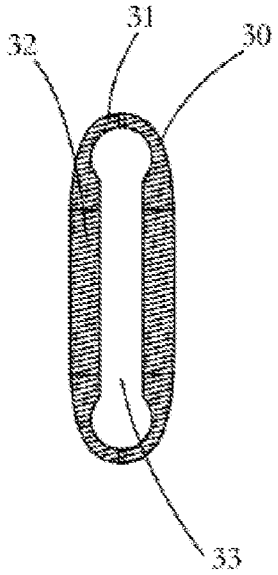
FIG. 2 is a cross-sectional view of the fixing member 30 of FIG. 1.

As shown in FIGS. 1 and 2, in a specific embodiment of an earphone according to the present invention, it comprises an earphone body 10, an earphone cord 20, and a fixing member 30.

The earphone body 10 includes an earplug portion 11, a connecting portion 12, and a body portion 13. The earplug portion 11, when worn, is a component that is placed in the human ear canal; the body portion 13 is a component of a main circuit assembly and a sound reinforcement assembly for accommodating the earphone, and is worn outside the cavitas conchae of the human ear when worn; the connecting portion 12 is connected to the earplug portion 11 and the body portion 13, and is placed in the cavitas conchae of the human ear when worn.

The earphone cord 20 is threaded out from the bottom of the body portion 13; the earphone may not have the earphone cord 20, for example, a Bluetooth earphone. In the present embodiment, only the earphone with the earphone cord 20 is taken as an example to explain the present invention.

The fixing member 30 is a ring, and the middle portion of the ring is a through hole 35; the connecting portion 12 passes through the through hole 35 and is fastened in the fixing member 30. In a specific first embodiment, the ring is a perfect circle. Preferably, the shape and size of the through hole 35 are matched with the outer surface of the connecting portion 12 to ensure the stability of the fastening.

Figure 3:
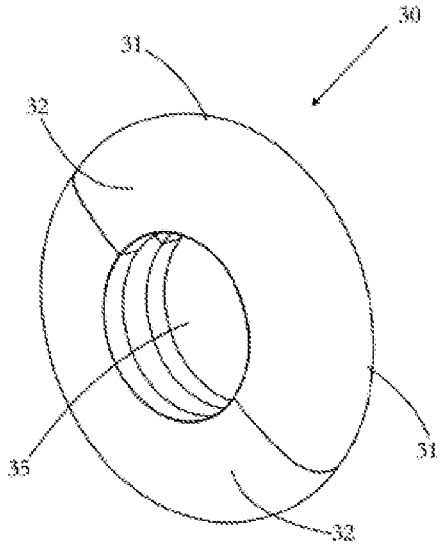
FIG. 3 is a perspective enlarged view of the fixing member 30 of FIG. 1.

With reference to FIGS. 2 and 3 together, the fixing member 30 includes a side wall 31 on both sides of the ring, and the top wall 31 is made of a soft material such as silica gel or other soft gel. When the top wall 31 is pressed by an external force, deformation is liable to occur. Preferably, the top wall 31 is thin-walled, making it more susceptible to deformation.

Preferably, the fixing member 30 further includes two side walls 32 on both sides of the ring, and the top wall 31 and the side walls 32 are enclosed to form an air groove 33. That is, the inside of the fixing member 30 is hollow, and the overall shape is similar to a tire. As shown in FIG. 2, the air groove 33 has a cross section of dumbbell shape, and the cross section is perpendicular to the plane in which the fixture 30 is located and passes through the diameter of the fixing member 30, that is, the shape in which the two ends are thick, and the middle is thin. This shape of the air groove 30 ensures that the fixing member 30 may improve the compatibility of the fixing member 30 and achieve a more stable and comfortable wearing effect.

Preferably, the side wall 32 is made of a material having a certain hardness, and specifically, a hard material, or a thick soft material, such as thick silica gel or a thick other soft gel material. As long as it is placed in the cavitas conchae, it may play a supporting role, and it may not be dislodged from the cavitas conchae due to the deformation of the external force.

Preferably, the top wall 31 is provided with a vent hole 34 thereon, and when the top wall 31 is deformed, air in the air groove 33 may be discharged from the vent hole 34. Preferably, the vent hole 34 is disposed at an upper portion of the fixing member 30, and the vent hole 34 is exposed from the cavitas conchae when worn. The so-called upper portion, that is, the upward portion of the earphone when it is worn.

Figure 4:
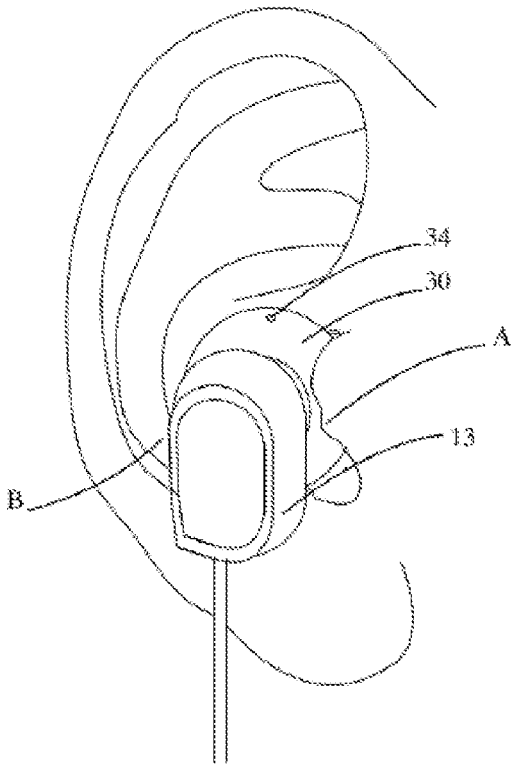
FIG. 4 is a diagram showing the state of use of FIG. 1 worn on the human ear.

As shown in FIG. 4, when in use, the earplug portion 11 is placed in the external auditory canal, and the fixing portion 30 and the connecting portion 12 are placed together in the cavitas conchae, that is, the fixing member 30 and the connecting portion 12 are components of the earphone placed in the cavitas conchae of the human ear. The tragus A and the antitragus B act on the side wall 32 of the fixing portion 30. The space enclosed by the tragus A, the antitragus B and the cavitas conchae forms a supporting force in other directions other than the upward force on the fixing portion 30. Thereby, the fixing portion 30 is caught in the cavitas conchae of the ear. The vent hole 34 is located at the upper portion of the fixing portion 30, and when the top wall 31 is pressed, the air in the air groove 33 is discharged from the vent hole 34.

Since the side wall 32 of the fixing portion 30 has a certain hardness, it is less likely to be deformed and may provide a stable supporting action. Since the top wall 31 is made of a material that is susceptible to deformation, adaptive deformation is performed to match the different cavitas conchae when subjected to the compression of the cavitas conchae.

According to the first embodiment of the present invention, since the top wall 31 which is susceptible to deformation is used in the fixing member 30, an adaptive change is made to the cavitas conchae of different people, thereby improving the wearing comfort of the earphone. At the same time, since the side wall 32 which is not easily deformed is used on the fixing member 30, when the fixing member 30 is snapped in the cavitas conchae by the tragus A and the antitragus B, it does not escape from the gap between the tragus A and the antitragus B due to the deformation of the side wall 32, thereby ensuring the stability of the wearing of the earphone.

Figure 5:
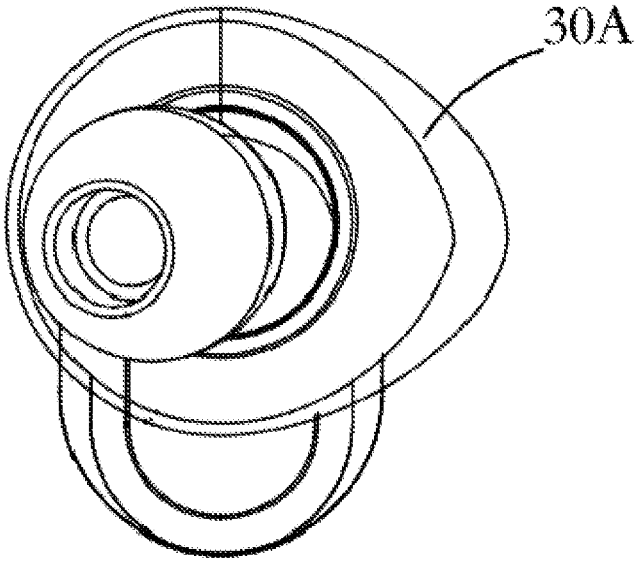
FIG. 5 is a perspective view of a fixing member 30*a* according to a second embodiment of the present invention.

As shown in FIG. 5, according to a second embodiment of an earphone in the present invention, a perspective view of a fixing member 30A is illustrated. The second embodiment is different from the above-described first embodiment in that a portion of the fixing member 30A located on a side of the antitragus has an elliptical shape. Overall, the fixture 30A is similar to a horizontal drop shape. This shape of the fixing member 30A is more closely matched with the shape of the body's cavitas conchae, which further enhances the wearing comfort and stability.

The foregoing is only preferred exemplary embodiments of the present invention and is not intended to be limiting of the present invention. Any modifications, equivalent substitutions, improvements and the like within the spirit and principles of the present invention are intended to be embraced by the protection range of the present invention.

We claim:

1. An earphone comprising:

an earphone body, the earphone body including an earplug portion, a connecting portion, and a body portion; and a fixing member shaped as a ring, wherein:

a middle portion of the fixing member includes a through hole, the fixing member includes a side wall on each of two sides of the fixing member and a top wall located at an edge of the ring, the top wall being made of an elastic material, the connecting portion is connected to the earplug portion and the body portion, the connecting portion passes through the through hole and is fastened in the fixing member, the fixing member is placed in a cavitas conchae of a human ear, the top wall of the fixing member is elastically deformed under pressing of the cavitas conchae, the top wall comprises a vent hole, and in response to the top wall being deformed, the top wall and the side walls of the fixing member are enclosed to form an air groove configured to discharge air in the air groove from the vent hole.

2. The earphone according to claim 1, wherein the fixing member is removably positioned in the cavitas conchae between a tragus and an antitragus of an ear bone of the human ear.

3. The earphone according to claim 1, wherein the top wall is made of silica gel.

4. The earphone according to claim 1, wherein the top wall is thin-walled to be susceptible to deformation.

5. The earphone according to claim 1, wherein the side wall is made of a substantially firm material such that the fixing member serves as a support.

6. The earphone according to claim 1, wherein the side wall is made of an elastic material that is substantially thick to serve as a support.

7. The earphone according to claim 1, wherein the vent hole is provided at an upper portion of the fixing member.

8. The earphone according to claim 1, wherein a first portion of the fixing member on a side of tragus is circular and a second portion of the fixing member on a side of an antitragus is elliptical.

9. The earphone according to claim 1, wherein the air groove includes a dumbbell shape in a cross section of the fixing member, and the cross section is perpendicular to a plane in which a fixture is located and passes through a diameter of the fixing member.

10. The earphone according to claim 1, wherein the ring is round-shaped.

11. An earphone comprising:

an earphone body, the earphone body including an earplug portion, a connecting portion, and a body portion, the connecting portion being attached to the earplug portion at one end and the body portion at the other end; and a deformable generally-torus ring shaped fixing member made of an elastic material, the fixing member having a central through hole, an outer wall, an air groove within the outer wall, and a vent hole located in the outer wall;

wherein the connecting portion extends through the through hole of the generally-torus ring shaped fixing member; and wherein when the earphone is placed in a cavitas conchae of a human ear, the outer wall is elastically deformed by pressing of the cavitas conchae, and is compressed to discharge air from the air groove through the vent hole.

* * * * *